United States Patent [19]

Arlt, III et al.

[11] Patent Number: 4,746,247

[45] Date of Patent: May 24, 1988

[54] STABILIZING RING FOR INTERLOCKING LOAD RING/BACK FLANGE INTERFACE

[75] Inventors: Edward J. Arlt, III; Frank J. Kovitch; Donald MacLachlan; Charles M. Reinhardt, all of Arlington, Tex.

[73] Assignee: Lockheed Corporation, Calabasas, Calif.

[21] Appl. No.: 8,946

[22] Filed: Jan. 30, 1987

[51] Int. Cl.[4] ..... B63B 21/50

[52] U.S. Cl. ..... 405/224; 403/124; 403/130; 405/202

[58] Field of Search ..... 405/202, 224, 195; 114/264, 265; 403/122, 124, 130, 165, 228

[56] References Cited

U.S. PATENT DOCUMENTS

| | | | |
|---|---|---|---|
| 2,846,252 | 8/1958 | Herbenar et al. | 403/130 |
| 3,329,454 | 7/1967 | Melton et al. | 403/130 X |
| 4,320,993 | 3/1982 | Hunter | 405/224 |
| 4,432,670 | 2/1984 | Lawson | 405/224 |

*Primary Examiner*—David H. Corbin

*Attorney, Agent, or Firm*—Eric R. Katz

[57] ABSTRACT

An improved keyhole latch is provided for securing offshore structures in place. The back flange of the flex joint and latch assembly has a male portion and the load ring of the receptacle has a female portion. By matching the male and female portions, rolling of the load ring and flex joint and latch assembly is minimized and the noncontinuous surface on the load ring is strengthened.

8 Claims, 2 Drawing Sheets

FIG. 1
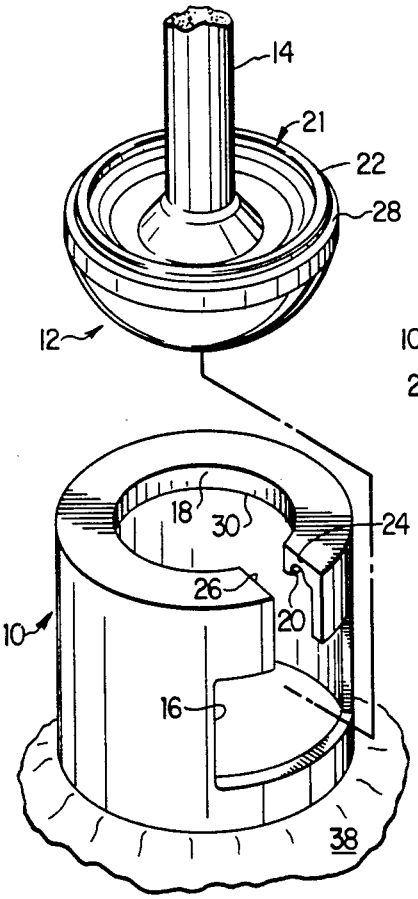
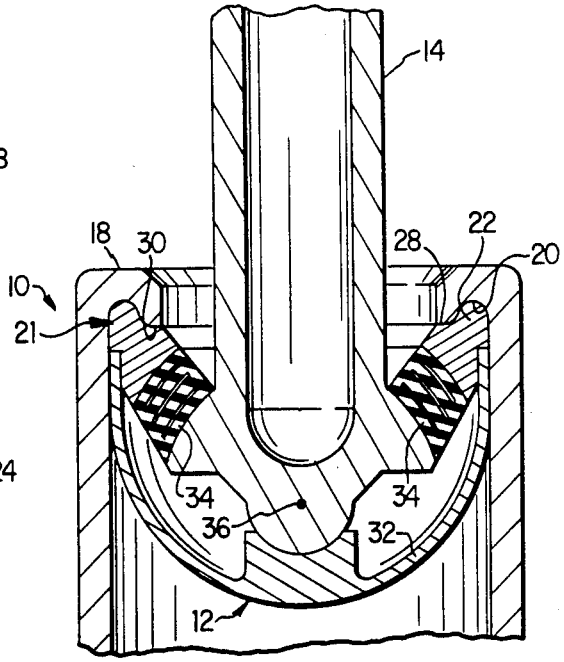
FIG. 2
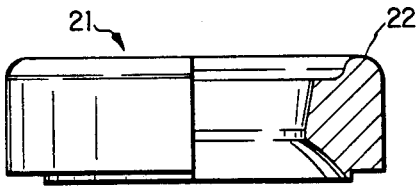
FIG. 3
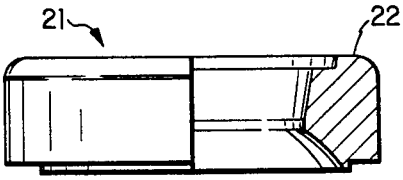
FIG. 4

STABILIZING RING FOR INTERLOCKING LOAD RING/BACK FLANGE INTERFACE

TECHNICAL FIELD

This invention relates to keyhole latch designs for both the lower and upper ends of a tension leg platform tether system, and more particularly to a design with the load ring and flex joint back flange engaging as interlocking beams.

BACKGROUND OF THE INVENTION

Offshore structures such as a tension leg platform have long been used in different enterprises including oil and gas research platforms. There is typically a need to secure the platform to the sea floor. One method developed for this purpose is the keyhole latch anchor design which can be used at both the lower (sea floor) or upper (platform) ends of a tension leg platform tether system.

The keyhole latch design at the lower end of the tether system incorporates a receptacle anchored to the sea floor and a flex joint and latch assembly. The flex joint and latch assembly is attached to a tension member which extends upward to the floating offshore structure. The tension member is attached to the floating structure by a similar upper keyhole latch design. By inserting the flex joint and latch assemblies into the associated receptacles and then applying a suitable tension to the tension member, the floating offshore structure is secured in place.

Several disadvantages exist in the present design. Due to the currently designed keyhole latch geometry, some rolling of the back flange of the flex joint and latch assembly load ring on the receptacle will occur under load. This creates very high stresses and fretting on the back flange and load ring. Also, since the load ring must be segmented, i.e., a noncontinuous surface, to allow insertion of the flex joint and latch assembly, these stresses tend to force the load ring apart at the keyhole slot. If enough stress is applied, the anchor can be destroyed and will allow the flex joint and latch assembly to break free of the receptacle.

SUMMARY OF THE INVENTION

The present invention is an improvement for keyhole latch designs. A keyhole latch is comprised of a receptacle with a keyhole shaped entry port and a flex joint and latch assembly which are attached to a tethering system. A keyhole latch is usually mounted between the sea floor and the lower end of a tension member and another latch between the upper end of the tension member and the floating platform. The receptacle of the lower latch is secured to the sea floor by a bottom template structure. The flex joint and latch assembly of the lower latch is attached to the lower end of the tension member, which is in turn attached to the floating offshore structure through the upper latch. When the flex joint and latch assembly is inserted into the receptacle through the keyhole port, the floating offshore structure is secured in position.

This improvement provides an interlocking male and female structure between the receptacle load ring and the back flange of the flex joint and latch assembly. Preferably, the back flange of the flex joint and latch assembly is provided with a male portion and the receptacle load ring with a female portion. As the flex joint and latch assembly is moved into position, the male portion interlocks with the female portion, thus providing a more stable interface with an interlocking beam structure. Since the receptacle and load ring must be a noncontinuous surface to accommodate the flex joint and latch assembly, the interlocking structure increases the strength of the receptacle and helps prevent destruction of the receptacle and load ring through large deformations under tension.

BRIEF DESCRIPTION OF THE DRAWINGS

For a more complete understanding of the present invention and for further advantages thereof, reference is now made to the following Description of Preferred Embodiments taken in conjunction with the accompanying drawings, in which:

FIG. 1 is a perspective view of a first embodiment of the present invention;

FIG. 2 is a cross-sectional view of the first embodiment of the present invention;

FIG. 3 is a partial cross-sectional view of the back flange of the flex joint and latch assembly of the first embodiment;

FIG. 4 is a partial cross-sectional view of the back flange of the flex joint and latch assembly forming a second embodiment.

DESCRIPTION OF THE PREFERRED EMBODIMENTS

Figure 5:
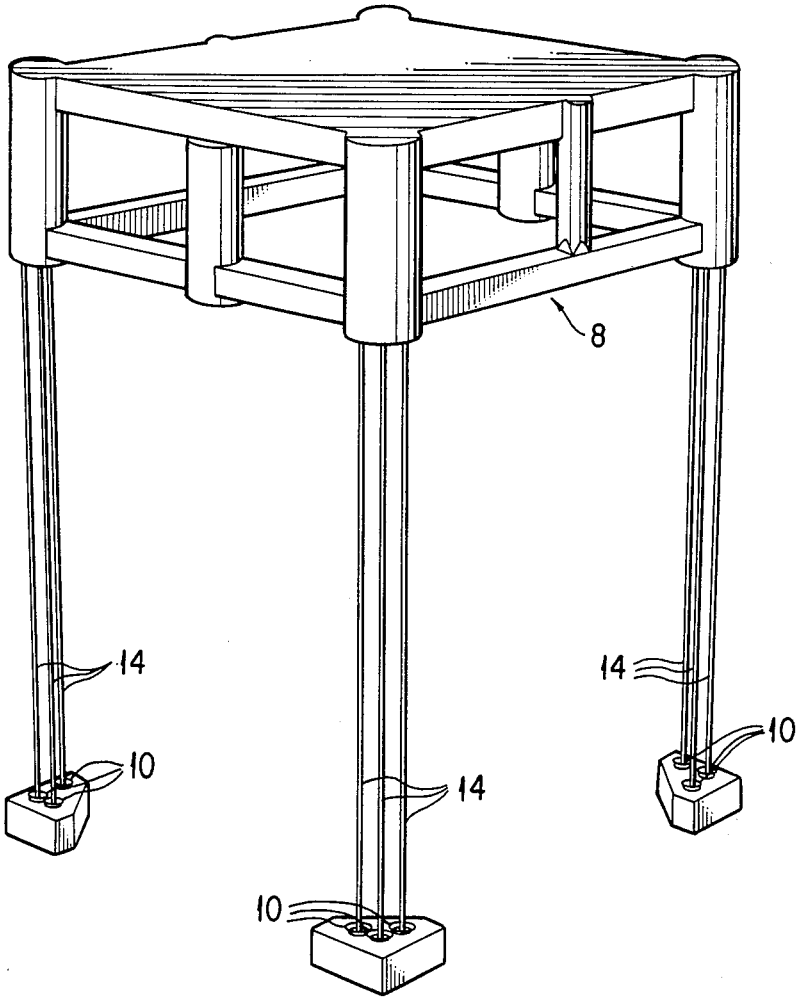
FIG. 5 is a perspective view of one embodiment of the present invention shown with an offshore structure.

FIG. 1 shows one embodiment of the present invention in which a hollow cylindrical receptacle structure 10 is secured to the floor 38 of a body of water. Hollow receptacle structure 10 may have other cross-sectional shapes such as square, rectangular, and elliptical. Formed integrally with the top of the hollow receptacle structure 10 is a load ring 18. Load ring 18 has a groove or first mating surface 20 on its underside 30.

Flex joint and latch assembly 12 is formed to match the top cross-sectional shape of hollow cylindrical receptacle structure 10. In FIG. 1, flex joint and latch assembly 12 is shown to have a circular shape when viewed from the top. Attached to flex joint and latch assembly 12 is the lower end of a tension member 14 which is attached to an offshore structure 8, for example, a floating platform as shown in FIG. 5. Flex joint and latch assembly 12 has a back flange 21 with a lip or complementary second mating surface 22 on its top surface 28 which is shaped to match the groove 20 on the underside 30 of load ring 18.

Hollow cylindrical receptacle structure 10 has a keyhole 16 cut into it to allow flex joint and latch assembly 12 and attached tension member 14 to be inserted. In order to allow tension member 14 to be inserted, load ring 18 is also cut, forming a separate first end 24 and second end 26. As can best be seen in FIG. 2, flex joint and latch assembly 12 has been inserted into keyhole 16 and seated into position. The back flange 21 with lip 22 on top surface 28 of flex joint and latch assembly 12 is mated with groove 20 on the underside 30 of load ring 18 as the tension member 14 urges the flex joint and latch assembly 12 toward the load ring 18. This mating forms an interlocking beam structure which tends to prevent flex joint and latch assembly 12 from rolling out of engagement with receptacle 10 and also serves to strengthen load ring 18 at the gap between first end 24 and second end 26, thus preventing the gap from widening which could allow flex joint and latch assembly 12 to slip out of receptacle 10.

Previous designs without this improvement were forced to use greater amounts of materials to maintain the integrity and strength of the hollow cylindrical receptacle structure 10. Due to the improvement of this invention, less material can be used, resulting in a cost savings, and the strength can actually be improved. This is due directly to the interlocking action between lip 22 on back flange 21 and groove 20 on load ring 18.

As can be seen in FIGS. 3 and 4, lip 22 on back flange 21 can be various shapes. Groove 20 preferably is formed to match the lip 22 to create the interlocking action. Further, a mirror image design is possible where a lip can be formed on load ring 18 to mate with a groove on back flange 21, if desired.

Flex joint and latch assembly 12 is comprised of pod 32 and an elastomeric bearing assembly 34. Elastomeric bearing assembly 34 is formed of alternating layers of elastomeric material and rigid plates curved with a center of curvature on pivot point 36. Elastomeric bearing assembly 34 allows tension member 14 to pivot about pivot point 36.

While the invention has been illustrated using the example of the lower latch for connecting the lower end of a tension member to the sea floor, the configuration of the upper latch connecting the upper end of the tension member to the floating platform is essentially identical. For example, the receptacle at the upper latch will commonly be attached to the platform, while the flex joint and latch assembly of the upper latch is attached to the upper end of the tension member.

Although the present invention has been described with respect to a specific preferred embodiment thereof, various changes and modifications may be suggested to one skilled in the art, and it is intended that the present invention encompass such changes and modifications as fall within the scope of the appended claims.

We claim:

1. An improved keyhole latch assembly comprising:

a hollow receptable having sides and an open end;

a non-continuous load ring having an underside formed integrally with said receptacle and extending inwardly from said sides, said underside of said load ring having a first mating surface;

a flex joint and latch assembly having a back flange defining an upper suface, said upper surface having a second mating surface, complementary to said first mating surface, for interlocking said underside of said load ring with said upper surface of said back flange of said flexible joint and latch assembly;

one of said first and second mating surfaces being a groove and the other of said first and second mating surface being a protrusion for mating with said groove;

a tension member attached to said flex joint and latch assembly for exerting a tensioning force which urges said first mating surface of said load ring and said complementary second mating surface of said upper surface of said flex joint and latch assembly into interlocking engagement;

said hollow receptacle having an opening formed in one of said sides to allow insertion of said flex joint and latch assembly and a portion of said tension member;

whereby the flex joint and latch assembly and portion of the attached tension member are inserted into the keyhole so that said complementary second mating surface of the upper surface on the back flange of the flex joint and latch assembly is urged into interlocking engagement with the first mating surface of the underside of the load ring of the hollow receptacle due to the biasing force exerted by said tension member.

2. An improved keyhole latch assembly according to claim 1 wherein said protrusion spans the non-continuous portion of said load ring.

3. An improved keyhole latch assembly according to claim 1, wherein:

said first mating surface comprises a groove on the underside of said load ring at a predetermined position; and said complementary second mating surface comprises a protrusion matched in complementary shape and position to said groove of said first mating surface of said load ring.

4. An improved keyhole latch assembly according to claim 2, wherein:

said protrusion is a 360° circumferential protrusion positioned on said upper surface of said back flange of said flex joint and latch assembly.

5. An anchoring system for securing an offshore structure to the floor of a body of water comprising:

a hollow receptacle having sides and an open end, said receptacle being attached to the floor of the body of water;

a non-continuous load ring having an underside formed integrally with said receptacle and extending inwardly from said sides, said underside of said load ring having a first mating surface;

a flex joint and latch assembly having a back flange defining an upper surface, said upper surface having a second mating surface, complementary to said first mating surface, for interlocking said underside of said load ring with said upper surface of said back flange of said flexible joint and latch assembly;

a tension member attached to said flex joint and latch assembly at one end and attached to said offshore structure at the other end, said tension member for exerting a tensioning force which urges said first mating surface of said load ring and said complementary second mating surface of said upper surface of said flex joint and latch assembly into interlocking engagement;

said hollow receptacle having an opening formed in one of said sides to allow insertion of said flex joint and latch assembly and a portion of said tension member;

one of said first and second mating surfaces being a groove and the other of said first and second mating surfaces being a protrusion for mating with said groove;

whereby the flex joint and latch assembly and portion of the attached tension member are inserted into the keyhole so that said complementary second mating surface of the upper surface on the back flange of the flex joint and latch assembly is urged into interlocking engagement with the first mating surface of the underside of the load ring of the hollow receptacle due to the biasing force exerted by said tension member.

6. An anchoring system according to claim 5, wherein:

said protrusion spans the non-continuous portion of said load ring.

7. An anchoring system according to claim 5 wherein:

said first mating surface comprises a groove on the underside of said load ring at a predetermined position; and said complementary second mating surface comprising a protrusion matched in complementary shape and position to said groove of said first mating surface of said load ring.

8. An anchoring system according to claim 7, wherein:

said protrusion is a 360° circumferential protrusion positioned on said upper surface of said back flange of said flex joint and latch assembly.

* * * * *